United States Patent [19]

Kuhlen

[11] 4,199,535

[45] Apr. 22, 1980

[54] DIAPHRAGM PUMP

[75] Inventor: Ernst Kuhlen, Willich, Fed. Rep. of Germany

[73] Assignee: Pierburg GmbH & Co., KG, Neuss, Fed. Rep. of Germany

[21] Appl. No.: 10,840

[22] Filed: Feb. 8, 1979

[30] Foreign Application Priority Data

Feb. 22, 1978 [DE] Fed. Rep. of Germany ..... 2807514

[51] Int. Cl.[2] ..... F02M 7/08

[52] U.S. Cl. ..... 261/34 A; 417/386; 417/395

[58] Field of Search ..... 417/386, 395, 402; 261/34 A

[56] References Cited

U.S. PATENT DOCUMENTS

| | | | |
|---|---|---|---|
| 1,268,780 | 6/1918 | Jay | 417/395 |
| 2,092,482 | 9/1937 | Timian | 417/395 |
| 2,494,529 | 1/1950 | Wirtanen | 417/395 |
| 2,552,261 | 5/1951 | Coughlin | 417/395 |
| 2,919,650 | 1/1960 | Wiggermann | 417/386 |
| 3,162,324 | 12/1964 | Houser | 417/395 |
| 3,421,448 | 1/1969 | Brewer et al. | 417/395 |
| 3,429,274 | 2/1969 | Nilsson | 417/395 |
| 3,955,901 | 5/1976 | Hamilton | 417/395 |
| 4,110,058 | 8/1978 | Langle et al. | 417/395 |

FOREIGN PATENT DOCUMENTS

| | | | |
|---|---|---|---|
| 2614625 | 8/1977 | Fed. Rep. of Germany | 261/34 A |

*Primary Examiner*—Tim R. Miles

*Attorney, Agent, or Firm*—Haseltine, Lake & Waters

[57] ABSTRACT

A diaphragm pump operated by vacuum pressure and having a switching arrangement to control the continuous alternations between the intake stroke caused by vacuum pressure and the working stroke caused during venting by a spring after the end of each stroke. The switching arrangement consists of a crack-open valve between vacuum pressure chamber and a space continually connected to atmosphere, and a plunger, fastened to the diaphragm; the length of the plunger is variable through a spring clutch. The special action of the switching arrangement is based on the fact that the plunger requires a larger force for cracking the valve than afterwards for keeping it open. This is accomplished by having a differential pressure, act in the closing direction on the valve, and eliminating this force after opening, causing the spring-loaded plunger to extend to its full length and to keep open the valve during the entire working stroke of the diaphragm.

1 Claim, 6 Drawing Figures

DIAPHRAGM PUMP

BACKGROUND OF THE INVENTION

The present invention relates to a diaphragm pump, particularly a fuel diaphragm pump with a working chamber and a chamber separated from the working chamber by the diaphragm and having a compression spring. This chamber is connected to the intake pipe of an internal combustion engine downstream of the throttle flap of a carburetor for introducing vacuum pressure. At the end of the intake stroke of the pump, the diaphragm opens a valve for atmospheric venting of the second chamber by means of a plunger.

During idling and partial load operation of an internal combustion engine having a carburetor, such a pump serves to withdraw fuel continuously from the accelerator pump of a carburetor in order to prevent vapor bubble formation, caused by heat accumulation, in the accelerator pump through this scavenging. Another application in the motor vehicle, for example, as windshield wiper pump, is conceivable.

Such a pump is known from the German Laid-Open Document 26 14 625, published Aug. 28, 1977. However, this arrangement has the disadvantage that depending on the design layout, either the intake stroke or the working stroke of the pump cannot be carried out over the full stroke since venting either takes place before the intake stroke is finished, or evacuation takes place before the working stroke is finished. Hence the delivery is unsatisfactory.

Accordingly, it is an object of the present invention to provide such a pump where the design stroke of the diaphragm is fully utilized.

Another object of the present invention is to provide a pump of the foregoing character which is substantially simple in construction and may be economically fabricated.

A further object of the present invention is to provide a pump, as described, which is reliable in service and has a substantially long operating life.

SUMMARY OF THE INVENTION

The objects of the present invention are achieved by arranging over the plunger a moveable spring clutch whose spring pushes the sleeve of the clutch away from the end of a plunger having a shoulder, the end facing away from the diaphragm; the valve is formed by a spring-loaded plate located in a space connected to atmosphere via a jet nozzle.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
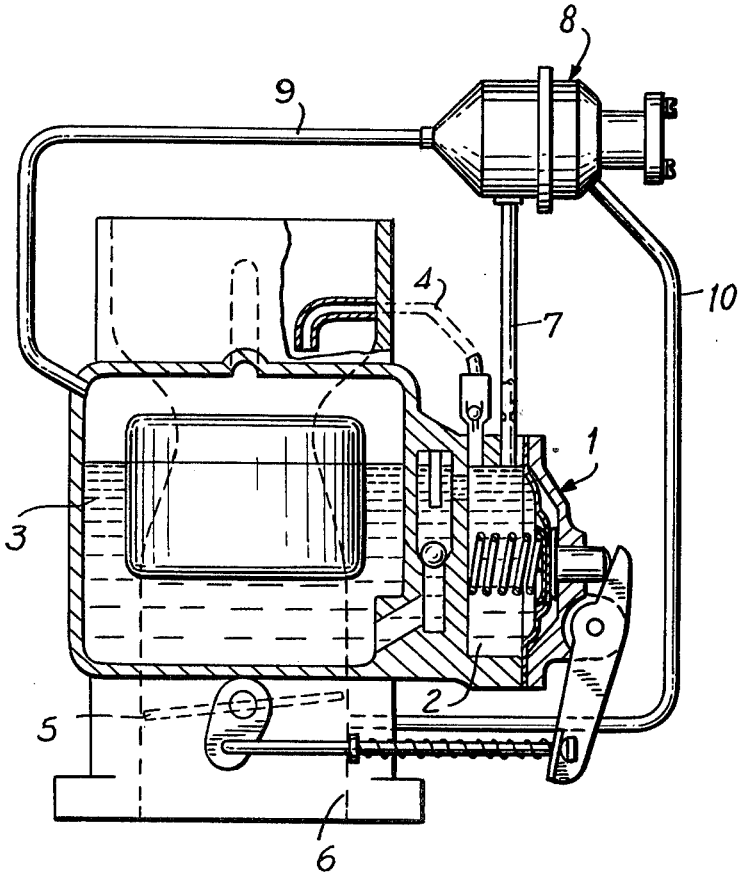
FIG. 1 shows a partial sectional view of a carburetor with the additional pump.
Figure 2:
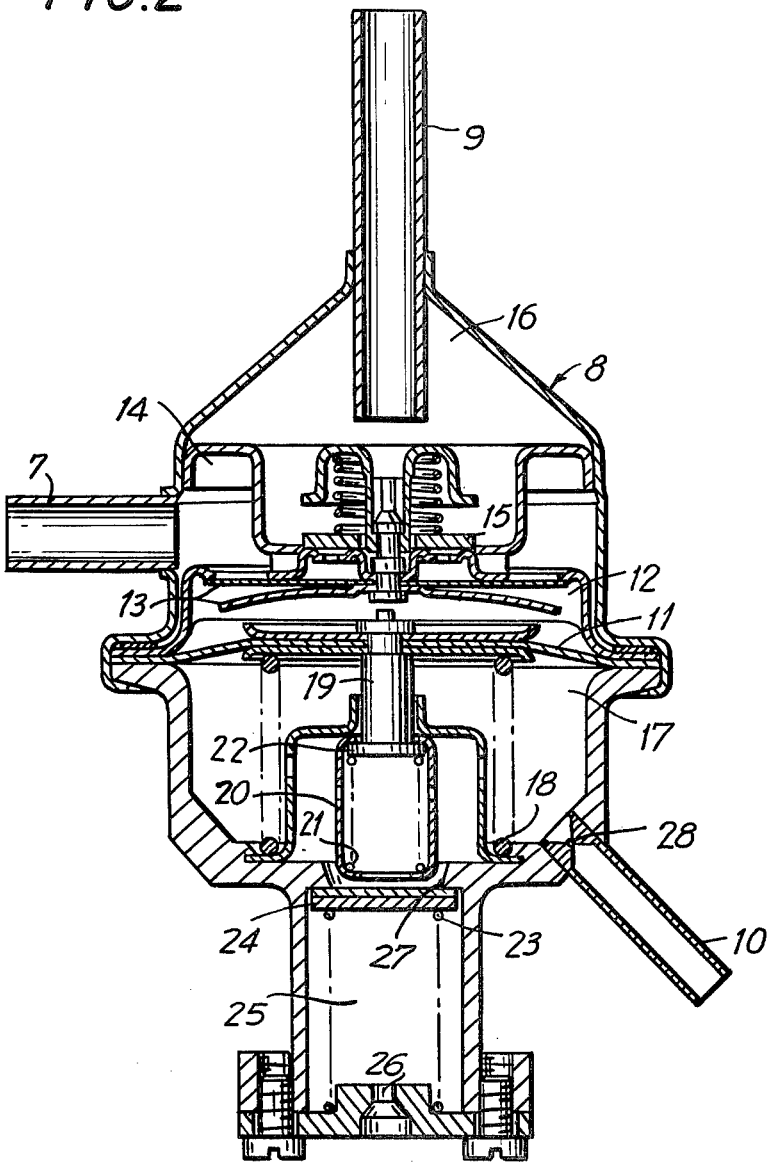
FIG. 2 shows a sectional view of the pump on an enlarged scale.

FIG. 1 shows a known carburetor for an internal combustion engine (not shown). The carburetor has a conventional accelerator pump 1 with an expansion chamber 2 which is connected to a float chamber 3 with constant level, and to an injection pipe 4 which discharges above the throttle flap 5 into the intake pipe 6. A line 7 leads from the working chamber 2 of the accelerator pump 1 to a pump 8 which acts as a virtual circulating pump, since it delivers the fuel drawn by it from the accelerator pump 1 via line 9 back to the float chamber 3. Pump 8 is connected via a line 10 to the intake pipe 6 downstream of the throttle flap 5. According to FIG. 2, pump 8 is divided by a diaphragm 11 into two chambers.

The working chamber 12 is connected via valves 13 to suction cavity 14 and hence to intake 7. The working chamber 12 is connected to the pressure space 16 via a spring-loaded valve 15. The outlet line 9 issues from this pressure space. The second chamber 17 has a compression spring 18. A plunger 19 is fastened to diaphragm 11; a spring clutch 20 is shiftably placed at the other end of this plunger. A spring 21 pushes the clutch 20 away from the end of the plunger 19 having a shoulder 22; this end faces away from the diaphragm. The second chamber 17 is connected to space 25 via a valve, which is formed by a plate 24 loaded by a spring 23, and space 25 is connected to atmosphere via a jet 26. Upon terminating the suction the plunger opens the aforementioned valve.

Figure 3A:
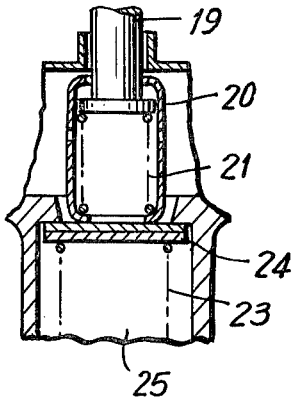
FIGS. 3*a–c* show a detail of the pump in various positions.

The intake pipe underpressure (vacuum) supplied via line 10 evacuates the second chamber 17 underneath the membrane 11 and moves the diaphragm 11 against the force of spring 18. In the process, the sleeve of the spring clutch 20 contacts 24. The spring sleeve is open at its jacket and its front surface. Plate 24 is acted upon by a force resulting from the pressure difference between chamber 17 and space 25, and by the force of spring 23 in the closure direction with valves 24/27 closed. During a further downward movement of the diaphragm 11—FIG. 3*a* shows the relative position of plunger and spring coupling 20 in this phase at the start of the intake stroke—the pot of clutch 20 is shifted so far against the force of compression spring 21 till the force of plunger 19 acting on plate 24 in the opening direction exceeds the sum of the opposing forces.

Figure 3B:
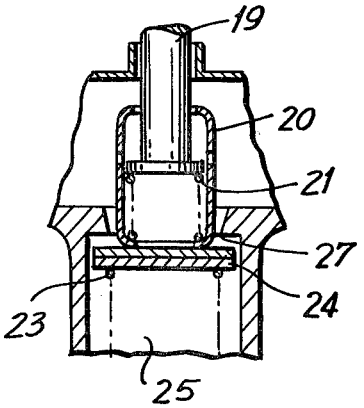
Figure 3C:
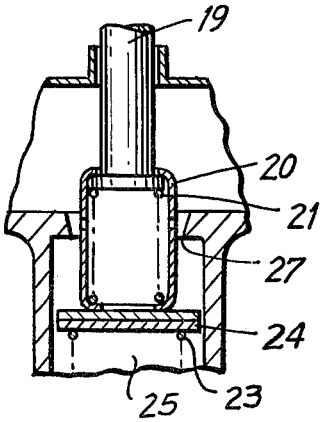

The intake stroke provided by the pump design is ended. Plate 24 lifts off the valve seat 27, opening chamber 17 to space 25 and equalizing the pressure between them. FIG. 3*b* shows the relative position of plunger 19 and spring clutch 20 at that instant. Suddenly the force acting on the spring clutch in the closure direction is reduced below atmospheric pressure, the underpressure (vacuum) in chamber 17 bleeding into space 25 and acting on plate 24, whereupon the compression spring 21 shifts the pot of clutch 20 and simultaneously the plate 24 by a certain amount against the force of the softer compression spring 23 suddenly downward, as shown in FIG. 3*c*.

Chamber 17 is vented via the opened valve 24,27 and the jet 26, since the flow at jet 26, because of its dimensions, is much larger than the flow on the much smaller jet 28 in the underpressure (vacuum) connection 10. As a result, diaphragm 11, driven by the force of compression spring 18, carries out the working stroke of the pump 8. At the same time, the plunger 19 and the plate 24 move upwards until the plunger lifts off the plate 24 contacting the valve seat 27; now the plate has closed the connection between chamber 17 and space 25. Chamber 17 is now again evacuated via jet 28 by the underpressure (vacuum) applied to connection 10 and the working cycle described repeats itself.

During the downward movement of diaphragm 11, the chamber 12 of pump 8 is enlarged. Via inlet connection 7, suction space 14 and inlet valve 13, the medium handled is aspirated with the outlet valve 15 closed.

During the subsequent upward movement of diaphragm 11, the working chamber 12 is again reduced and the medium handled is passed along, with the inlet valve 13 closed, via the outlet valve 15, the pressure space 16 and the outlet connection 9.

Figure 4:
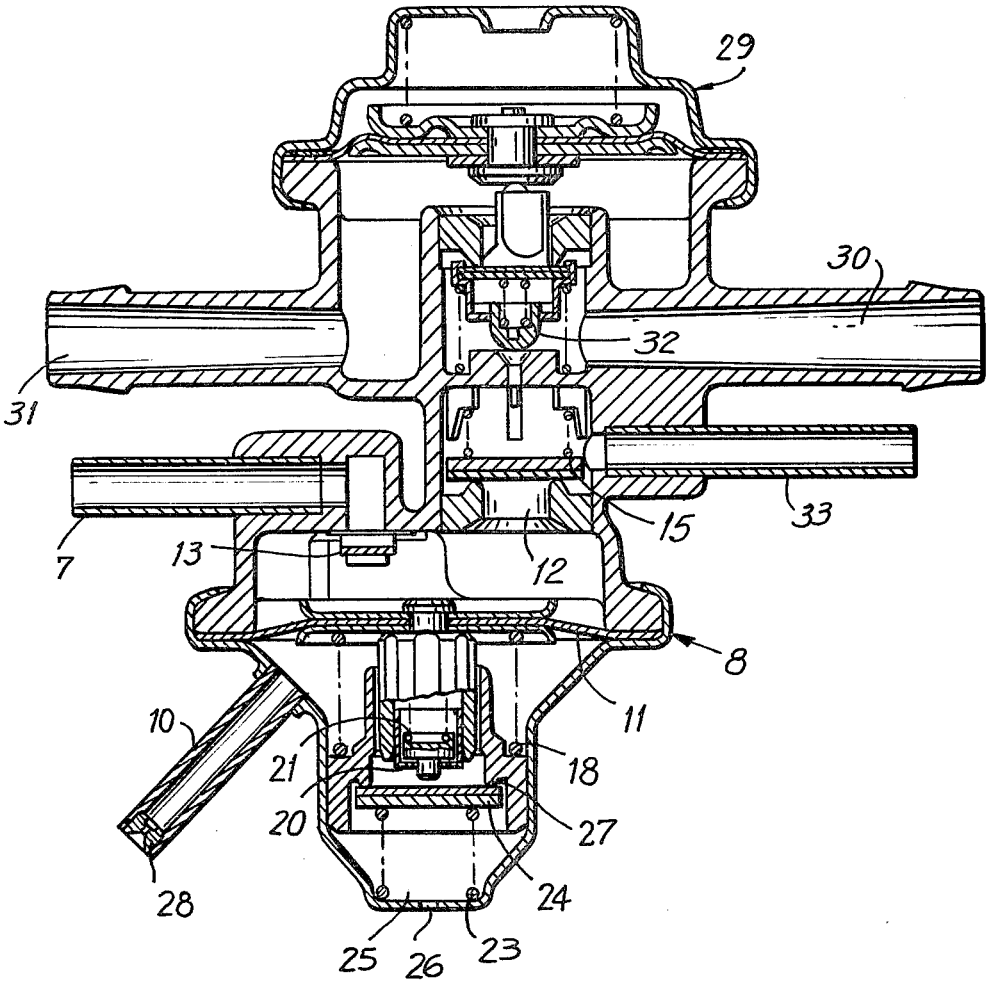
FIG. 4 shows the combination of the pump with a known pressure control valve.

FIG. 4 shows the combination of the above-described pump with a pressure control valve 29 located between a fuel pump (not shown) on the carburetor. The reference numerals for the pump 8 were retained and the positions are mentioned in the following text only to the extent required. The fuel is delivered to the pressure control valve from the fuel pump via a line connection 30. The fuel reaches the float chamber of a carburetor via a line connection 31. The pressure control valve 29 has a known return valve 32 which opens as soon as the fuel pressure exceeds a predetermined amount. The controlled fuel quantity enters a return 33 to the tank. The fuel delivered by the pump 8 discharges into this return 33 via the valve 15 closing the working space 12.

This design combines the two components in a basis construction in a simple manner.

Without further analysis, the foregoing will so fully reveal the gist of the present invention that others can, by applying current knowledge, readily adapt it for various applications without omitting features that, from the stand-point of prior art, fairly constitute essential characteristics of the generic or specfic aspects of this invention, and therefore, such adaptations should and are intended to be comprehended within the meaning and range of equivalence of the following claims.

What is claimed is:

1. A fuel diaphragm pump comprising: a working chamber; an auxiliary chamber; a diaphragm separating said auxiliary chamber from said working chamber; compression spring means in said auxiliary chamber; an internal combustion engine intake pipe connected to said auxiliary chamber downstream from the throttle flap of a carburetor for introducing vacuum pressure; a plunger; valve means; said diaphragm opening said valve by means of said plunger at the end of an intake stroke of said pump for atmospherically venting said auxiliary chamber; moveable spring clutch means arranged at the end of said plunger remote from said diaphragm, said spring clutch means having a spring and a sleeve, said spring pushing said sleeve away from an end of said plunger, said end facing away from said diaphragm; said valve means comprising a spring-loaded plate and a jet nozzle, said spring loaded plate being located in a space connected to atmosphere via said jet nozzle.

* * * * *